US006270401B1

(12) United States Patent
Wormmeester

(10) Patent No.: US 6,270,401 B1
(45) Date of Patent: Aug. 7, 2001

(54) AIR DIFFUSER WITH UNITARY VALVE ASSEMBLY

(75) Inventor: David Wormmeester, Grand Rapids, MI (US)

(73) Assignee: Hart & Cooley, Inc., Holland, MI (US)

( * ) Notice: Subject to any disclaimer, the term of this patent is extended or adjusted under 35 U.S.C. 154(b) by 0 days.

(21) Appl. No.: 09/585,995

(22) Filed: Jun. 2, 2000

Related U.S. Application Data

(60) Provisional application No. 60/137,409, filed on Jun. 3, 1999.

(51) Int. Cl.[7] ..... F24F 13/14

(52) U.S. Cl. ..... 454/290; 454/322; 454/325

(58) Field of Search ..... 454/290, 322, 454/325, 333, 335

(56) References Cited

U.S. PATENT DOCUMENTS

| | | | | |
|---|---|---|---|---|
| 2,222,081 | | 11/1940 | Leigh . | |
| 2,595,885 | * | 5/1952 | Rhoades | 454/325 |
| 2,705,973 | | 4/1955 | Kice . | |
| 3,720,154 | * | 3/1973 | Biggi | 454/325 X |
| 4,625,632 | * | 12/1986 | Markman et al. | 454/290 |
| 4,876,952 | | 10/1989 | Kuno et al. | 454/333 X |
| 4,887,522 | | 12/1989 | Kuno et al. | 454/333 X |
| 4,991,496 | | 2/1991 | Kuno et al. . | |

FOREIGN PATENT DOCUMENTS

| | | | | |
|---|---|---|---|---|
| 38388 | * | of 1913 | (GB) | 454/325 |

* cited by examiner

*Primary Examiner*—Harold Joyce
(74) *Attorney, Agent, or Firm*—Rader, Fishman, Grauer & McGarry, an office of Rader, Fishman & Grauer PLLC

(57) ABSTRACT

An air diffuser is adapted to be fluidly connected to an air duct. The air diffuser comprises a face and a unitary valve assembly. The face comprises a number of openings separated by louvers, which are preferably of a fixed angular orientation. The unitary valve assembly comprises vanes that are rotatably attached to a body by a deformable web that is integral to the valve assembly body and the vanes. The vanes are adjusted by means of an adjustment arm that extends from each vane through the openings in the face. The unitary valve assembly is preferably constructed of a single piece of material that is shaped so that it will attach to the face. The valve assembly is unitary, requiring no assembly except to the face. The deformable webs are sized so as to give a high cycle life to the assembly, and allow the vanes to be fixedly adjusted.

15 Claims, 4 Drawing Sheets

AIR DIFFUSER WITH UNITARY VALVE ASSEMBLY

RELATED APPLICATIONS

This application claims the benefit of U.S. Provisional Application Ser. No. 60/137,409 filed on Jun. 3, 1999.

BACKGROUND OF THE INVENTION

1. Field of the Invention

The invention relates to an air diffuser for regulating and directing the flow of conditioned air from a supply duct or ventilation system into a room or other adjoining space; and, more specifically, a closable floor diffuser having a unitary valve assembly, improving and simplifying the diffuser construction.

2. Related Art

Air diffusers are commonly used to control the flow of conditioned air from an air duct into a room. A typical air duct extends from a heating/cooling unit and terminates in an outlet at the interior surface of a structural panel, such as a floor, wall or ceiling. The duct outlet is enclosed by the air diffuser.

Contemporary air diffusers generally comprise a housing having one portion that is sized to be received within the duct outlet while extending through the structural panel and another portion that overlies a portion of the structural panel surrounding the panel opening and air duct outlet. Air is generally diffused by a constriction of the air passage through the diffuser, often in the form of a plurality of alternating ribs and openings.

Many contemporary air diffusers have a series of openings or vents that are closable by a moveable valve assembly to control the flow of conditioned air into the room. The moveable valve assembly can include a fixed grid and a moveable grid. Each grid is formed by a series of alternating ribs and openings. In the open position, the openings of each grid are aligned. In the closed position, the ribs of one grid are aligned with the openings of the other grid.

Another common moveable valve assembly includes a plurality of generally planar rotatable vanes, each having a longitudinal shaft, so they may be rotatably mounted within opposing openings, transversely aligned to the direction of air flow, in the air diffuser face. The vanes are then rotated about their shaft, from a generally parallel configuration, allowing maximum air flow, to a generally coplanar configuration, producing maximum constriction of the air flow. The vanes are generally planar, as stated above, but may display some degree of curvature transverse to their longitudinal axis.

The prior art air diffusers are relatively complex in the number of parts, the movement of parts, and their assembly. Given that, in general, air diffusers are mass produced products, any reduction in the assembly time and complexity, such as reducing the number of parts, results in a significant improvement in cost. There is a continuing need to reduce the cost of these articles.

SUMMARY OF THE INVENTION

The invention relates to an improved air diffuser for controlling the flow of air from a duct to a room. The air diffuser comprises a cover and a valve assembly. The cover has multiple spaced louvers, with openings between adjacent louvers, whereby air is directed into the room by the louvers. The valve assembly comprises a frame defining a valve opening in which is positioned a vane connected to the frame by a deformable web. The vane is rotatable an axis between a closed position where the vane substantially blocks the valve opening to substantially prevent the flow of air through the valve opening, and an open position where the vane permits the flow of air through the valve opening. The improvement relates to the vane being mounted to the frame by a deformable web, connecting the vane to the frame along the axis, whereby as the vane is rotated between the closed and open positions, the deformable web is twisted about the axis.

The web is preferably integrally formed with the frame and the vane. For example, the frame, vane and web can be stamped from a metal blank. The deformable web has a length to width ratio range of 2:1 to 10:1.

The vane can have an elongated shape with opposing ends, with a web connecting one of the opposing ends to the frame and another web connecting the other of the opposing ends to the frame. Both webs are preferably on the axis. The vane can also have a longitudinal strengthening rib.

The vane can further include an adjustment arm extending normally from the vane and terminating in a tip extending beyond the cover whereby the arm can be moved to rotate the vane about the axis. The arm preferably extends from the vane at a location spaced away from the axis.

The vane assembly can have multiple vanes, each of which can have a different axis. The vanes can be oriented such that some or all of the axes are parallel, oblique, or transverse relative to each other.

The frame preferably comprises a mounting flange that is generally co-planar relative to the cover and a skirt extending from the mounting flange and substantially circumscribing the valve opening to define a well, wherein the web connects to the skirt of the frame. The skirt terminates in an inwardly directed flange and the web connects to the flange.

In another aspect, the invention relates to a blank for forming an air diffuser valve assembly. The blank comprises a generally planar perimeter portion comprising opposing sides connected by opposing ends to define an opening in which is positioned a plate having opposing ends adjacent the perimeter portion ends and opposing sides adjacent the perimeter portion sides. The vane is connected to the planar perimeter portion by a deformable web.

Preferably, the vane substantially fills and is co-planar with the perimeter portion of the opening. The perimeter portion sides and the perimeter portion opposing ends each have an upper edge and a lower edge, with the lower edges intersecting to define the opening and the perimeter portion further having lower bend lines spaced from the lower edges. The perimeter portion opposing ends and perimeter portion opposing sides have an upper bend line parallel to the lower bend lines and located between the lower bend line and the upper edge.

The body opening preferably includes an extension projecting into one of the perimeter portion opposing sides and perimeter portion opposing ends and the plate further comprises a finger received within the body opening extension whereby when the finger is bent normally relative to the plate it forms an arm for rotating the plate about the deformable web, which has a length to width ratio of 2:1 to 10:1.

Other objects, features, and advantages of the invention will be apparent from the ensuing description in conjunction with the accompanying drawings.

DETAILED DESCRIPTION

Figure 1:
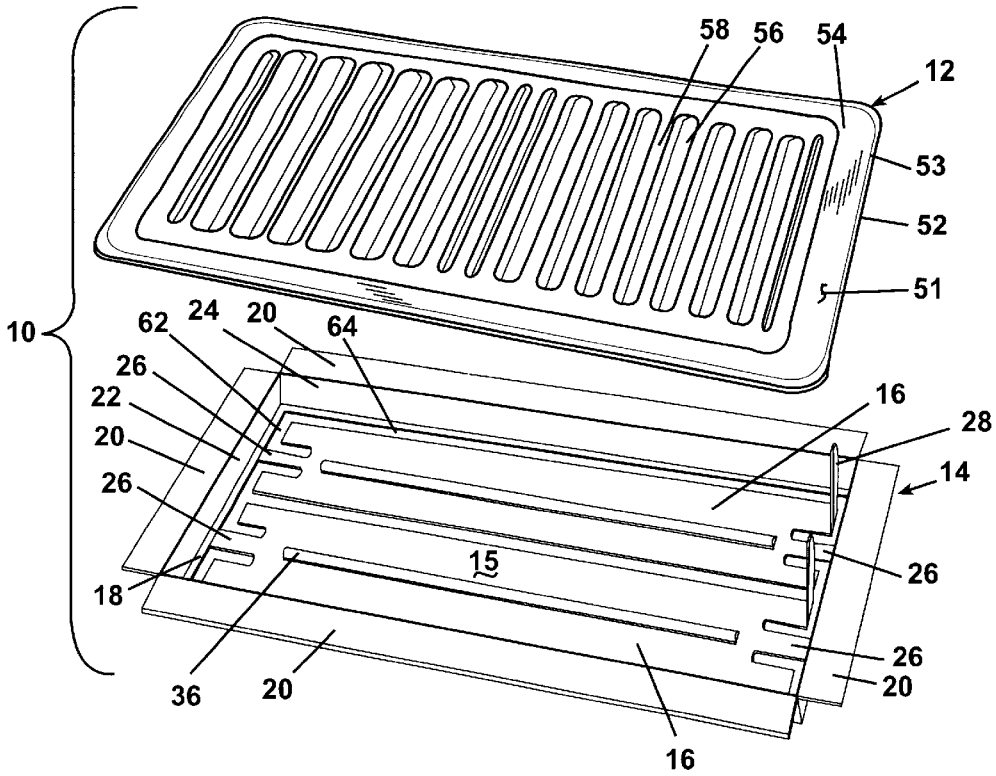
FIG. 1 is an exploded perspective view of an air diffuser according to the invention and illustrating a face with parallel louvers and openings and a valve assembly with a plurality of adjustable vanes with adjustment arms co-located at one end of the air diffuser.
Figure 2:
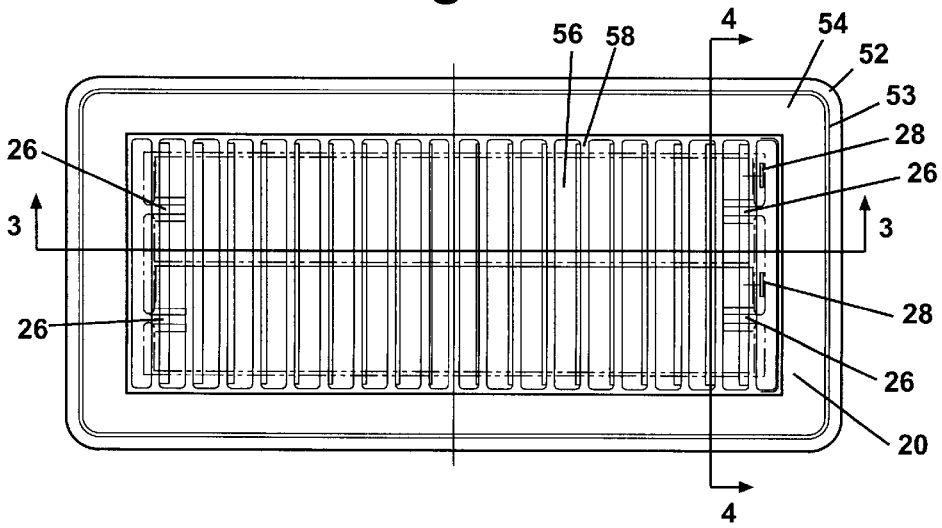
FIG. 2 is a plan view of the assembled air diffuser of FIG. 1 showing the valve assembly beneath in phantom.

FIGS. 1–5 illustrate a first embodiment of an air diffuser 10 comprising a face 12 and a unitary valve assembly 14 according to the invention. The face 12 is preferably of stamped or punched metal manufacture and comprises a peripheral lip 51 bound by a peripheral edge 52, which is adapted to rest flush with a receiving, usually planar surface such as a floor or wall. The lip 51 further comprises a peripheral mounting surface 54 that is connected to the peripheral edge 52 by a transition section 53. The peripheral mounting surface 54 is elevated relative to the peripheral edge 52 to form a gap with the receiving surface. The face 12 further comprises substantially parallel elongate face openings 56 in an upper surface of the face and separated by generally parallel elongate louvers 58 formed during the stamping process of the face 12. The elongate louvers 58 are preferably oriented at an angle relative to the plane of the face 12 for air flow directional control.

The unitary assembly 14 is preferably stamped from a single piece of sheet metal, and the components bent into a configuration so that it may be assembled with the face 12 into an air diffuser 10. The valve assembly 14, in its use configuration, comprises a well 15 formed by opposing parallel ends or end skirts 22 and, substantially perpendicular to the end skirts 22, opposing parallel sides or side skirts 24. The bottom of the well is formed by substantially flat, elongate vanes 16, which are surrounded by perimeter portions 18. The vanes 16 each have a raised longitudinal strengthening rib 36. The perimeter portions 18 comprise the bottom end of each of the end and side skirts 22,24. Each skirt 22,24 is substantially perpendicular to its perimeter portion 18, with the perimeter portions 18 extending inwardly from the skirts 22,24 to form the flat perimeter of the bottom of the well, with the skirts 22,24 forming a wall of the well. Again, interior to the perimeter portions 18, at the bottom of the well, lie the vanes 16. The vanes 16 are separated from the perimeter portion 18 of the end skirts 22 by an end gap 62, and are spaced from the perimeter portion 18 of the side skirts 24 by a side gap 64. The vanes 16 are attached to the perimeter portion 18 at each end skirt 22 by a deformable web or pivot link 26.

Preferably, the width of the gaps 62,64 will be minimized, to allow movement of the vanes 16 while minimizing air passage when the valve assembly is closed, i.e., when the vanes 16 are aligned with the bottom of the well. The width of the gaps 62,64 will be determined by the method of manufacture of the unitary valve assembly 14.

Each of the end skirts 22 and side skirts 24 terminates at the top in a mounting flange 20, which extends perpendicularly to its respective skirt 22,24, and to the outside of the well formed by the skirts, so as to form a substantially flat perimeter mounting flange around the top of the well. The mounting flange 20 may be then attached to the peripheral mounting surface 54 by any conventional means such as welding or mechanical affixation.

Figure 3:
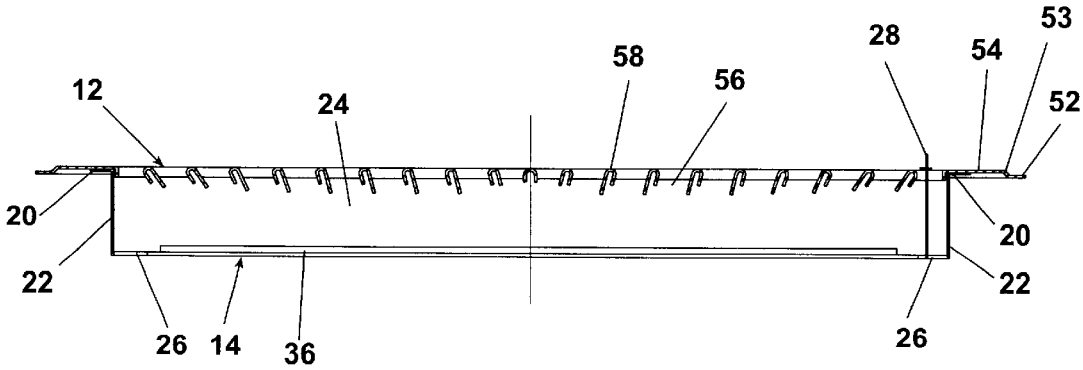
FIG. 3 is a sectional view taken through line 3—3 of FIG. 2.
Figure 4:
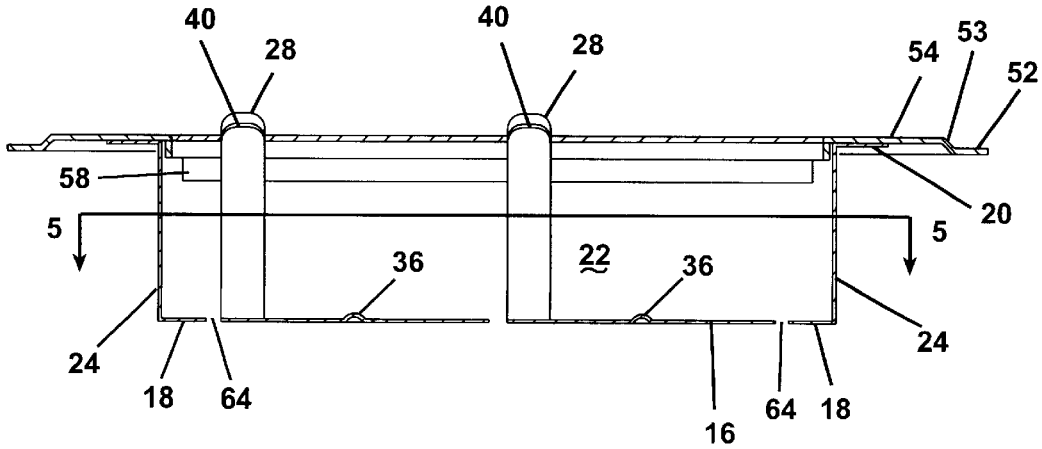
FIG. 4 is a sectional view taken through line 4—4 of FIG. 2.
Figure 5:
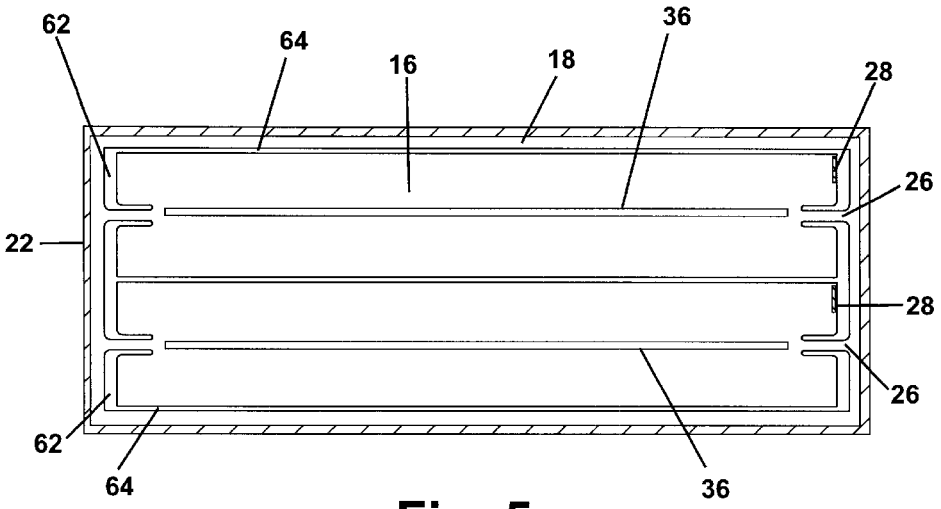
FIG. 5 is a sectional view taken through line 5—5 of FIG. 4.

An adjustment arm 28 is formed at an end of each vane 16. The arms 28 are co-located at an end of the valve assembly 14. Each adjustment arm 28 extends generally perpendicularly from the plane of the vane 16 so as to extend up through the well beyond the plane formed by the mounting flanges 20, and through one of the face openings 56 of the assembled air diffuser 10, as best seen in FIG. 3. The adjustment arm 28 has an adjustment arm opening 40 by which either a remote means of controlling the adjustment arm 28 may be used, or multiple adjustment arms 28 may be simultaneously controlled.

In the first embodiment illustrated in FIGS. 1–4, the pivot link 26 is depicted as extending from the longitudinal center of the vane 16. However, this is not a strict limitation as to the location of the pivot link 26, which, depending on the desired rotation, can be placed at any longitudinal location.

The preferred embodiment of the air diffuser and the unitary valve assembly 14 is made from a metal stamping, typically steel. The unitary valve assembly 14 is preferably stamped from flat stock sheet metal, resulting in a unitary construction. The flat stamping is then bent to form the well 15 as has been described above in FIGS. 1–4. When the unitary valve assembly is first stamped, the vanes 16 are substantially coplanar with the perimeter portion 18. Upon shaping of the valve assembly, the vanes 16 and perimeter portion 18 will initially remain coplanar to each other, perpendicular to the skirts 22,24, and parallel to the mounting flanges 20.

Figure 6:
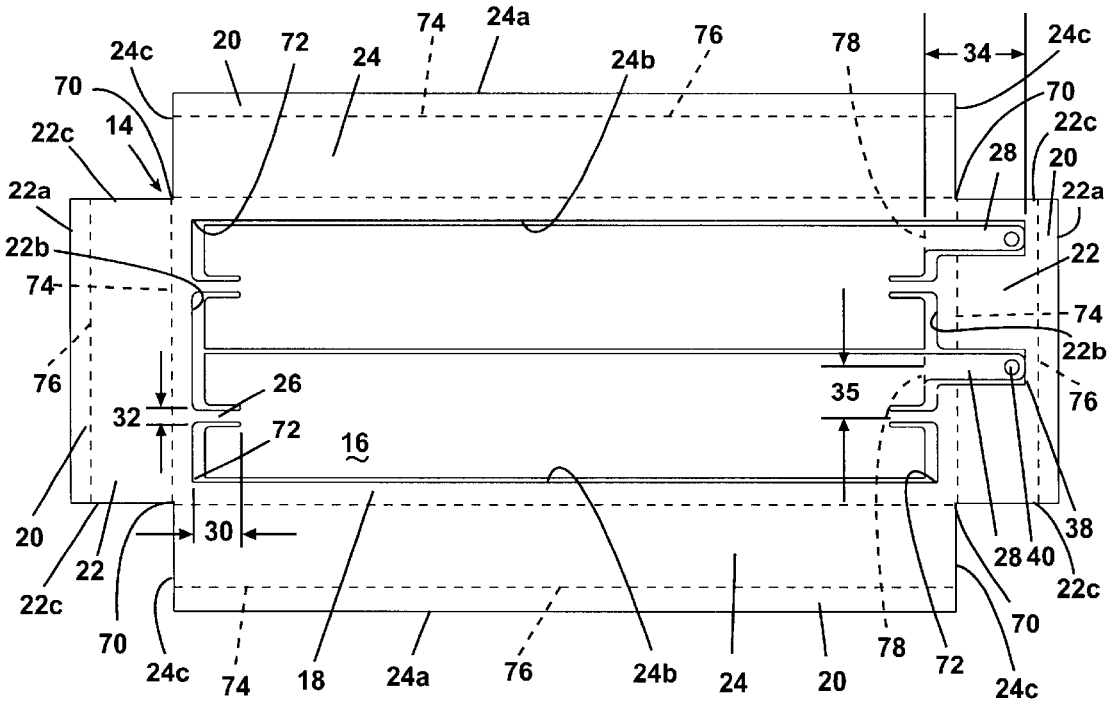
FIG. 6 is a plan view of a blank from which the valve assembly of FIGS. 1—5 is formed.

FIG. 6 is an example blank for making the unitary valve assembly 14. The figure shows that each of the end skirts 22 and side skirts 24 have upper edges 22*a*, 24*a* and lower edges 22*b*, 24*b*, which are connected by side edges 22*c*, 24*c*, respectively. The side edges 22*c*, 24*c* of adjacent end skirts 22 and side skirts 24 overlap and form intersections 70. The lower edges 22*b*, 24*b* form intersections 72 and collectively define the perimeter of the opening in which the vanes 16 lie.

In this embodiment, the adjustment arms 28 are cut out of one end 22, but this is not a strict limitation, as the adjustment arms may be situated on opposing ends of the vanes 16.

The pivot links 26 comprise a web extending from the plate or vane 16 to the adjacent end 22.

Bend lines 74 extend between the intersections 70 for each skirt end 22 and side 24. The sides 24 overlap the ends 22 so that when the ends 22 and sides 24 are bent along bend lines 74, the perimeter 18 of the well 15 is formed. Bend lines 76 extend across the span of each end 22 and side 24. When the ends 22 and sides 24 are bent along the mounting flanges 20 are formed around the perimeter of the stamping. Bend lines 78 are located at the intersection of the arms 28 with the plate forming the vanes 16.

The manufacture of the vane assembly will now be described. It should be noted that the manufacture includes many steps, especially the bending steps, whose sequence is unimportant to the invention. Therefore, the sequence described is merely for illustration purposes and not limiting to the invention. During the manufacture of the vane assembly, a planar sheet is stamped to form the blank shown in FIG. 6. The arms 28 are formed by bending the arms along the bend line 78 until the arms 28 are approximately perpendicular to the plane of the blank. The ends 22 and sides 24 are then bent downwardly relative to the blank as seen in FIG. 6 along bend lines 76 to form the mounting flanges 20. The ends 22 and sides 24 are then bent upwardly relative to the blank along bend lines 74 until they are substantially perpendicular to the plane of the blank to form the ends and sides and the perimeter 18.

Once the vane assembly is bent into its desired shape as described, the vane assembly is positioned relative to the cover 12 such that the arms 28 pass through the one of the openings in the cover 12 and the mounting flanges 20 abut the lip 51 if the cover 12. The mounting flanges 20 are then welded or otherwise secured to the cover 12 to complete the assembly.

The pivot link 26 has a pivot link length 30, and a pivot link width 32. The pivot link length 30 and pivot link width 32 must be selected carefully so as to provide sufficient stiffness to fixedly adjust the vanes 16, while providing sufficient malleability to allow manual adjustment and cycle life for the material used in the stamping. A ratio of the pivot link length 30 to the pivot link width 32 ranging from 2:1 to 10:1, depending upon the thickness and properties of the material used, has been found to provide satisfactory performance, but is not strictly limiting as to the proportions which will provide satisfactory performance.

The adjustment arms 28 have an adjustment arm length 34. It is desirable to have an adjustment arm length 34 such that the mounting flange 20, adjacent to the end skirt 22, does not have a gap where it will be attached to the peripheral mounting surface 54. The adjustment arms 28 have a length 34 so that the arms will extend through one of the face openings 56. The adjustment arms are spaced a predetermined distance from the pivot links to form a lever arm 35, whose length is selected to provide a sufficient lever arm to enable adjustment at a predetermined force, preferably a force capable of being applied by the weakest of the anticipated users. The various dimensions of the vanes 16 (the link width 32, the link length 30, the arm length 28, lever arm 35) are all selected in combination with the material properties to provide the predetermined minimum force for rotating the vane 16 about the links for a desired life cycle.

Figure 7:
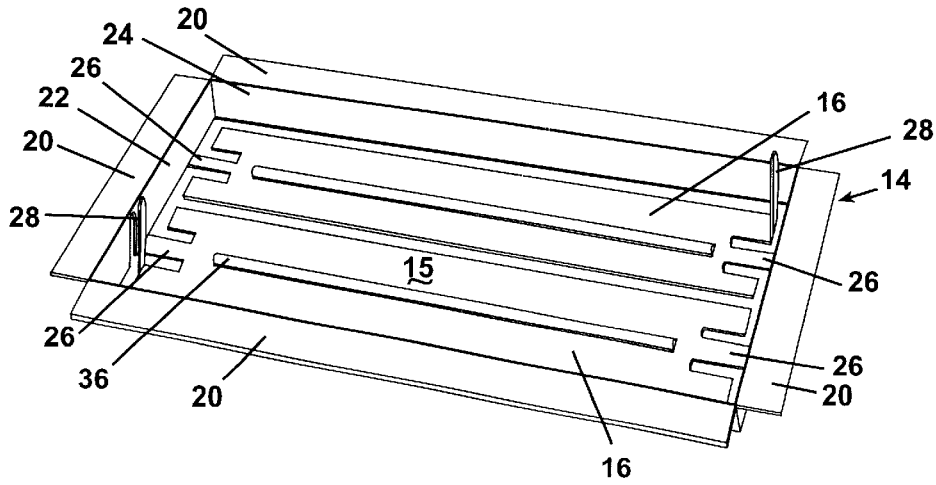
FIG. 7 is a perspective view of an alternative embodiment of the valve assembly of FIGS. 1–6, with the adjustment arms located on opposing ends of the air diffuser.

FIG. 7 depicts an alternative embodiment of the unitary valve assembly 14 wherein the adjustment arms 28 on adjacent vanes 16 are on opposing ends. Since the arms are located near the closest skirt 24, the greatest vane rotation occurs by moving the arm away from the nearest skirt, resulting in the counter-rotation of the vanes 16. In some applications, it is desirable to have the vanes 16 rotated in opposing directions and independently. By placing the adjustment arms on the opposing ends, the vanes 16 may be adjusted inwardly in an opposing manner without interference between the adjustment arms 28.

Figure 8:
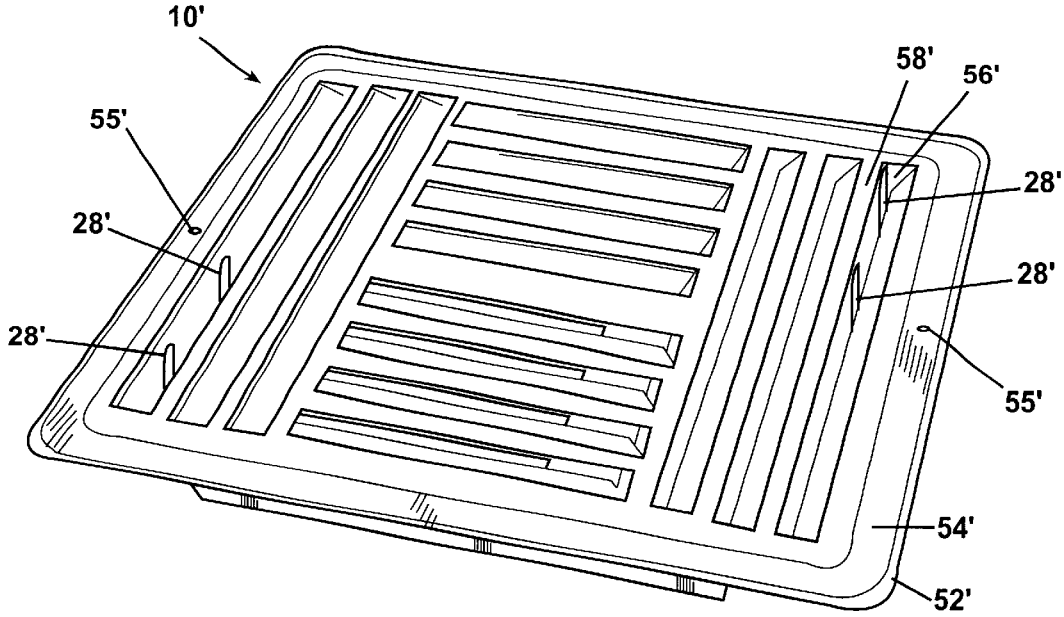
FIG. 8 is a perspective view of a "four-way" embodiment of the air diffuser, including transverse sets of parallel louvers and openings in the face, and incorporating the opposing adjustment arms of FIG. 7.

FIG. 8 is a perspective view of a "four-way" embodiment of the air diffuser 10'. The face openings 56' and louvers 58' in this alternative embodiment are grouped in subsets that are not all substantially parallel to each other, providing for air flow in multiple directions. It should be borne in mind that the array of vanes 16' may vary in length and width and in the number of vanes 16' in the array. The square array of FIG. 8 would likely have more than the two vanes 16' depicted in the first and second embodiments. It could likely have them adjustable in an opposing manner, as described in FIG. 7, or in any manner so as to facilitate the smooth flow of air through the unitary valve assembly 14' and between the fixed louvers 58'. This embodiment further comprises mounting holes 55' for mounting the air diffuser 10' to a planar surface.

While the invention has been specifically described in connection with certain specific embodiments thereof, it is to be understood that this is by way of illustration and not of limitation.

Examples of alternate embodiments that may be foreseen are dimensional and configurational alterations of the preferred embodiments, and the substitution of materials used in the unitary valve assembly, such as certain suitable plastics or other materials.

While the invention has been specifically described in connection with certain specific embodiments thereof, it is to be understood that this is by way of illustration and not of limitation, and the scope of the appended claims should be construed as broadly as the prior art will permit.

What is claimed is:

1. In an air diffuser for controlling the flow of air from a duct to a room, the air diffuser comprising:

a cover having multiple spaced louvers, with openings between adjacent louvers, whereby air is directed into the room by the louvers, and a valve assembly for controlling the volume of air from the duct through the cover, the valve assembly comprising:

a frame mounted to the cover and defining a valve opening for fluidly connecting the duct to the cover, and a vane positioned within the valve opening and mounted to the frame for rotation about an axis between a closed position where the vane substantially blocks the valve opening to substantially prevent the flow of air through the valve opening, and an open position where the vane permits the flow of air through the valve opening; the improvement wherein:

the vane is mounted to the frame by a deformable web integrally formed with the frame and the vane, said web connecting the vane to the frame along the axis, whereby as the vane is rotated between the closed and open positions, the deformable web is twisted about the axis.

2. The improvement according to claim 1 wherein the frame, vane and web are stamped from a metal blank.

3. The improvement according to claim 1 wherein the vane is elongated with opposing ends and there are two webs, one web connecting one of the opposing ends to the frame and the other web connecting the other of the opposing ends to the frame, and both webs are on the axis.

4. The improvement according to claim 3 wherein the vane comprises a longitudinal strengthening rib.

5. The improvement according to claim 3 and further comprising an adjustment arm extending normally from the vane and terminating in a tip extending beyond the cover whereby the arm can be moved to rotate the vane about the axis.

6. The improvement according to claim 5 wherein the arm extends from the vane at a location spaced away from the axis.

7. The improvement according to claim 3 wherein there are multiple elongated vanes with opposing ends and multiple deformable webs, with each vane being connected to the frame by at least one deformable web extending between the opposing ends and the frame.

8. The improvement according to claim 1 and further comprising an adjustment arm extending normally from the vane and terminating in a tip extending beyond the cover whereby the arm can be moved to rotate the vane about the axis.

9. The improvement according to claim 8 wherein the arm extends from the vane at a location off of the axis.

10. The improvement according to claim 1 wherein there are multiple vanes and multiple deformable webs, with each vane being connected to the frame by at least one deformable web and each vane having its own rotational axis.

11. The improvement according to claim 10 wherein the vanes are oriented such that all of the rotational axes are parallel.

12. The improvement according to claim 11 wherein the vanes are orientated such that at least two of the rotational axes are transverse.

13. The improvement according to claim 1 wherein the frame comprises a mounting flange that is generally co-planar relative to the cover and a skirt extending from the mounting flange and substantially circumscribing the valve opening to define a well, wherein the web connects to the skirt of the frame.

14. The improvement according to claim 13 wherein the skirt terminates in an inwardly directed flange and the web connects to the flange.

15. The improvement according to claim 1 wherein the deformable web has a length to width ratio range of 2:1 to 10:1.

* * * * *